US009815173B2

(12) United States Patent
Mase et al.

(10) Patent No.: US 9,815,173 B2
(45) Date of Patent: Nov. 14, 2017

(54) METHOD FOR GRINDING SIDE PORTION OF STACKED HARD, BRITTLE MATERIAL SUBSTRATE

(75) Inventors: Keiji Mase, Tokyo (JP); Shozo Ishibashi, Tokyo (JP)

(73) Assignee: FUJI MANUFACTURING CO., LTD., Tokyo (JP)

( * ) Notice: Subject to any disclaimer, the term of this patent is extended or adjusted under 35 U.S.C. 154(b) by 241 days.

(21) Appl. No.: 13/534,077

(22) Filed: Jun. 27, 2012

(65) Prior Publication Data

US 2013/0023187 A1 Jan. 24, 2013

(30) Foreign Application Priority Data

Jul. 21, 2011 (JP) ..... 2011-160147

(51) Int. Cl.
*B24C 1/04* (2006.01)
*B24C 3/22* (2006.01)

(52) U.S. Cl.
CPC . *B24C 1/04* (2013.01); *B24C 3/22* (2013.01)

(58) Field of Classification Search
CPC .. B24C 3/32; B24C 1/003; B24C 1/04; B24B 9/00; B24B 7/225
USPC ..... 451/39, 41, 44, 38, 60, 43, 40
See application file for complete search history.

(56) References Cited

U.S. PATENT DOCUMENTS 2,034,308 A * 3/1936 Morgan ..... B41M 1/305 101/32
3,078,546 A * 2/1963 Kiernan ..... 407/30
3,267,621 A * 8/1966 Meyers ..... B24C 1/04 451/31
3,482,423 A * 12/1969 Smith ..... B24C 1/04 451/29
3,535,758 A * 10/1970 Hoet ..... H01J 19/00 445/49

(Continued)

FOREIGN PATENT DOCUMENTS

JP 11-033886 2/1999
JP 2010-238310 10/2010

OTHER PUBLICATIONS

Jianbiao Pan, Gregory L. Tonkay, Alejandro Quintero ,Screen Printing Process Design of Experiements for Fine Line Printing of Thick Film Ceramic Substrates,1998 Proceedings of International Symposium on Microelectronics, San Diego, CA, USA, Nov. 1-4, 1998, pp. 264-269.*

*Primary Examiner* — Joseph J Hail
*Assistant Examiner* — Arman Milanian
(74) *Attorney, Agent, or Firm* — Cooper Legal Group LLC

(57) ABSTRACT

An elastic abrasive with abrasive grains dispersed in or adhered to an elastic base material is ejected toward a side portion of a substrate together with compressed air. The elastic abrasive is ejected toward a predetermined processing area centered on a processing point in an ejection direction that intersects a widthwise line at the processing point and that forms a predetermined inclination angle selected from a range of 2° to 60° relative to a contact line. Moreover, an ejection nozzle and the workpiece are moved relatively to each other so that the processing area is moved at a fixed speed in a circumferential direction of the workpiece and so that the ejection direction is maintained at each processing point after moving. If multiple stacked substrates are to be processed, the processing area is moved at a fixed speed also in a widthwise direction of the substrates.

7 Claims, 15 Drawing Sheets

(56) References Cited

U.S. PATENT DOCUMENTS 3,742,593 A * 7/1973 Smith ..... 451/38
3,953,941 A * 5/1976 Kuhn et al. ..... 451/2
4,931,120 A * 6/1990 Christoff ..... B24C 1/04 156/153
5,179,931 A * 1/1993 Leibowitz et al. ..... 125/30.01
5,332,643 A * 7/1994 Harada et al. ..... 430/127
5,486,134 A * 1/1996 Jones ..... B24B 7/17 451/209
5,644,828 A * 7/1997 Sailer ..... B23C 3/28 29/402.06
5,645,471 A * 7/1997 Strecker ..... 451/59
5,692,950 A * 12/1997 Rutherford et al. ..... 451/552
5,910,338 A * 6/1999 Donde ..... 427/290
5,998,755 A * 12/1999 Zajchowski et al. ..... 219/76.16
6,146,247 A * 11/2000 Nokubi et al. ..... 451/40
6,280,294 B1 * 8/2001 Miyamoto ..... B24B 9/107 451/103
6,402,593 B1 * 6/2002 Shaw ..... B24C 1/04 451/102
6,517,427 B1 * 2/2003 Yoshikawa et al. ..... 451/547
6,746,311 B1 * 6/2004 Kessel ..... 451/41
6,752,685 B2 * 6/2004 Ulrich et al. ..... 451/2
7,695,346 B2 * 4/2010 Ishibashi et al. ..... 451/39
2003/0027495 A1 * 2/2003 Shaw ..... 451/29
2004/0266317 A1 * 12/2004 Mase et al. ..... 451/2
2005/0205207 A1 * 9/2005 Minamihaba et al. .. 156/345.12
2006/0099888 A1 * 5/2006 Ishibashi et al. ..... 451/38
2007/0111643 A1 * 5/2007 Chien ..... 451/42
2007/0128987 A1 * 6/2007 Okada ..... B24C 1/02 451/29
2007/0196699 A1 * 8/2007 Aida ..... 428/846.1
2008/0057608 A1 * 3/2008 Ishibashi et al. ..... 438/42
2008/0226863 A1 * 9/2008 Prunchak et al. ..... 428/98
2009/0233529 A1 * 9/2009 Ueda ..... G11B 5/8404 451/41
2010/0059366 A1 * 3/2010 Brueckner et al. ..... 204/298.01
2011/0195279 A1 * 8/2011 Saeki ..... B08B 1/04 428/846.9

* cited by examiner

METHOD FOR GRINDING SIDE PORTION OF STACKED HARD, BRITTLE MATERIAL SUBSTRATE

BACKGROUND OF THE INVENTION

1. Field of the Invention

The present invention relates to methods for grinding side portions of hard, brittle material substrates, and more particularly, to a method for grinding edges and edge surfaces extending along the periphery of a substrate composed of a hard, brittle material, such as glass, quartz, ceramic, or sapphire (hereinafter, referred to as "hard, brittle material substrate"), and corners made of chamfered sections formed by cutting the aforementioned edges (the edges, the edge surfaces, and the corners of the edges will collectively be referred to as "side portion" in this specification).

In the present invention, the term "substrate" refers to a plate-like component on which a functional component is disposed for achieving a certain function, and includes a general so-called substrate, such as a glass substrate for a liquid-crystal display and a glass substrate for a hard disk, in addition to a glass cover with a liquid-crystal device for a portable phone and the like disposed on the rear face thereof so as to protect the device.

2. Description of the Prior Art

A glass substrate as an example of a hard, brittle material substrate is used as a flat-panel substrate in a liquid-crystal display for a liquid-crystal television, a personal computer, a portable information terminal, e.g. a portable phone, and a digital camera, or as a protective cover for protecting a liquid-crystal display. Moreover, since a glass substrate has low expansion and high impact resistance as compared with an aluminum substrate in the related art, the glass substrate is also used as a substrate for a hard disk. Thus, the industrial usage of glass substrates is increasing.

Such a glass substrate is cut into a predetermined shape, such as a rectangular shape if used as a flat-panel substrate or a donut-like shape if used as a hard-disk substrate, from a glass base material and is subsequently finished by grinding.

The grinding process for the glass substrate involves reducing the thickness thereof as much as possible or grinding a flat area thereof for improving the surface roughness. In addition, just after the glass substrate is cut, the edges (of the side portion) thereof tends to crack or chip easily. Moreover, if a crack or a micro-crack (small crack) formed in the cutting process remains in the side portion, the entire substrate may readily break from this cracked area when bending stress is applied to the substrate. Therefore, the grinding process is performed on the side portion so as to remove the edges by chamfering, and also to remove cracks and micro-cracks by polishing the edge surfaces and the chamfered sections to mirror finished surfaces.

Normal grinding methods that are currently performed for grinding the side portion of a glass substrate are roughly divided into a grinding method that uses a grindstone obtained by binding glass-grinding abrasive grains together with metal or resin as a binder and a grinding method that uses slurry containing abrasive grains.

As an example of the aforementioned grindstone-based grinding method, a method for grinding a hard-disk glass substrate by using a grindstone has been proposed. In this method, side portions of sheet-like glass substrates cut to predetermined dimensions are brought into contact with a rotating grindstone on a one-by-one basis. While monitoring the grinding amount, this grindstone is moved by NC control so as to chamfer the inner peripheral side and the outer peripheral side of each glass substrate and to grind the side portion thereof (Japanese Patent Laid-Open No. 2010-238310).

As an example of the aforementioned slurry-based grinding method, a method for grinding the inner periphery of an opening formed in the center of a hard-disk glass substrate has been proposed. When performing the grinding process with this method, a rotating brush is inserted into the central opening of a plurality of stacked glass substrates so as to bring the brush into contact with the inner peripheries of the openings. Then, the grinding process is performed by supplying slurry containing abrasive grains between the brush and the inner peripheries of the substrates at an appropriate timing (Japanese Patent Laid-Open No. H11-33886).

In the grinding method discussed in Japanese Patent Laid-Open No. 2010-238310, when using the rotating grindstone to grind the side surface and to chamfer the inner peripheral edge and the outer peripheral edge of each of the sheet-like glass substrates cut to predetermined dimensions, the grindstone is moved by NC control while the grinding amount is monitored. Thus, processing variations from product to product can be reduced, thereby allowing for a highly accurate process.

However, when glass, which is a hard, brittle material, is processed by using such a grindstone, seashell-shaped cut marks or chipped sections tend to form mainly at the end surfaces or at the corners if the workpiece is a plate. In addition, cracks or small cracks called micro-cracks (cut marks including such cracks and micro-cracks and occurrence thereof will collectively be referred to as "chipping" hereinafter) tend to form readily due to impacts caused during the cutting process.

These chipping tend to occur especially in sharp areas, such as the edges or the corners if the substrate is rectangular. If the side portion of the glass substrate is processed with an end mill in a front-end process prior to the grinding process, for example, grooves that correspond to positions where the end mill has passed and tool marks formed of sharp protrusions between the grooves are formed on the side portion, as shown in FIG. 13. If the substrate to be ground has such tool marks, the possibility of occurrence of the aforementioned chipping is further increased.

If the chipping is occurred, it is difficult to remove it completely by the grinding process. When bending stress is applied to the substrate, the glass substrate breaks readily starting from the chipped sections. Therefore, the strength of the glass substrate is significantly reduced.

In the grindstone-based process, the grindstone wears out and changes in shape as the processing amount increases. In addition, the grindstone clogs, resulting in lower grinding performance. Therefore, it is difficult to maintain constant processing quality, shape, and dimensions. If this is to be achieved, the processing amount needs to be monitored, and the grindstone needs to be replaced accordingly, making the management of the grindstone extremely complicated when performing the grinding process.

On the other hand, the slurry-based grinding process is performed by appropriately supplying slurry containing fine abrasive grains between a surface of the workpiece to be ground and the brush or a grinding pad that slides on the surface to be ground. Although the cutting performance with this method is lower than that in the grindstone-based grinding method, the occurrence of chipping can be significantly reduced even when grinding a glass substrate, which is a hard, brittle material substrate.

However, in this grinding method, when the slurry scattered throughout the working space dries, the fine abrasive grains in the slurry are scattered as dust and contaminate the working environment, which is a problem in that the dust may become a health hazard to workers.

In such a slurry-based grinding method, a relatively large amount of slurry is used since the slurry needs to be continuously supplied between the surface to be ground and the brush or the grinding pad. During the grinding process, the abrasive grains in the slurry break, changing the grain diameter, and heat generated due to the grinding causes the moisture to evaporate, thereby increasing the density of the abrasive grains. In addition, if foreign particles, such as shavings, produced from the grinding process are taken into the slurry, the foreign particles cannot be removed from the slurry. Thus, the quality of the slurry cannot be kept constant if the slurry is to be recycled, making it impossible to maintain the quality of the products.

Therefore, in the slurry-based grinding method, the slurry is normally disposed of after use, meaning that a large amount of abrasive grains is consumed as compared with the aforementioned grindstone-based grinding method.

Examples of abrasive grains generally used for grinding glass include fine diamond powder and fine cerium-oxide powder. Needless to say, diamond is an expensive material, and cerium oxide is also becoming an extremely expensive material because the worldwide demand therefor is increasing while cerium-oxide producing countries are putting stronger supply restrictions, such as mining restrictions, on cerium oxide. The use of disposable slurry containing such expensive materials as abrasive grains significantly increases the grinding costs.

In the brush-based grinding method discussed in Japanese Patent Laid-Open No. H11-33886, when grinding the inner peripheral surface of the stacked hard-disk glass substrates by using the rotating brush, as shown in FIG. 14, the grinding process is performed while supplying the aforementioned slurry between the brush and the surface to be ground. Therefore, this method is advantageous in that the occurrence of chipping can be prevented, as in the slurry-based grinding method described above.

Furthermore, since the grinding process is performed on the plurality of stacked glass substrates in the method discussed in Japanese Patent Laid-Open No. H11-33886, this method is advantageous in that the glass substrates can be simultaneously ground.

However, because the brush-based grinding method discussed in Japanese Patent Laid-Open No. H11-33886 is also a kind of slurry-based grinding method described above, there is a problem in that a large amount of expensive abrasive grains, such as fine diamond powder or fine cerium-oxide powder, is consumed.

Moreover, in the method discussed in Japanese Patent Laid-Open No. H11-33886, the brush, which is equipped with a shaft, used for the grinding is inserted into the central opening of the glass substrates in a state where only the upper end of the shaft is supported, as shown in FIG. 14. Therefore, even if a metal rod that is relatively resistant to deformation is used as the shaft of the brush, the lower end thereof wobbles during rotation such that the brush tips are not uniformly brought into contact with the surface to be ground. Therefore, when processing the stacked glass substrates, the degree of processing varies among the glass substrates in the height direction, which is a problem in that the quality varies from product to product.

In order to solve this problem, the brush would need to be moved vertically so as to reduce variations in the degree of processing in the height direction, or the grinding process would need to be performed multiple times while changing the stacking order of the glass substrates so as to make the degree of processing uniform. This results in lower workability due to a longer processing time.

Although glass substrates are described as an example of hard, brittle material substrates in the above description, the chipping may similarly occur when grinding substrates composed of a hard, brittle material other than glass, for example, quartz, ceramic, or sapphire, by using a grindstone. In addition, since expensive abrasive grains composed of diamond or cerium oxide are used, high grinding costs are required.

The present invention has been made to solve the problems in the related art described above, and an object thereof is to provide a method for grinding a side portion of a hard, brittle material substrate with good workability by preventing the occurrence of chipping, reducing the amount of abrasive grains consumed, preventing contamination of the working environment caused by abrasive grains, and allowing for a uniform grinding process for side portions of all substrates even when a plurality of stacked hard, brittle material substrates are simultaneously processed.

SUMMARY OF THE INVENTION

Solutions for solving the aforementioned problems will be described below together with reference numerals used in an embodiment of the present invention. These reference numerals are provided for clarifying the correspondence relationship between the claims of the invention and the embodiment of the invention, but are not to be used for limiting the interpretation of the technical scope of the invention.

In order to achieve the object described above, in a method for grinding a side portion of a hard, brittle material substrate according to the present invention, a side portion 10'S of a workpiece 10 formed of the hard, brittle material substrate 10' with flat plate shape is ground by ejecting an elastic abrasive 20 made of abrasive grains 22 dispersed in an elastic base material 21 (see FIG. 3A) or an elastic abrasive 20 made of abrasive grains 22 adhered to a surface of an elastic base material 21 (see FIG. 3B), from an ejection nozzle 30 toward the side portion 10'S of the workpiece 10 or the hard, brittle material substrate 10' together with compressed gas, excluding a slurry, so as to make the elastic abrasive 20 collide with the side portion 10'S, and the method comprises the steps of:

setting one point on the side portion 10'S arranged at a surface in a vertical direction of the hard, brittle material substrate 10' as a processing point P wherein a widthwise line W of the hard, brittle material substrate 10' extends through the processing point P and that a contact line T on the side portion 10'S extends orthogonally to the widthwise line W of the hard, brittle material substrate 10' and the contact line T is in contact with the side portion 10'S of the hard, brittle material substrate 10' at the processing point P;

ejecting the elastic abrasive 20 toward a predetermined processing area F centered on the processing point P in an ejection direction D that intersects the widthwise line W at the processing point P and the ejection direction D forms a predetermined inclination angle θ selected from a range of 2° to 60° relative to the contact line T; and moving the ejection nozzle 30 and/or the hard, brittle material substrate 10' relatively to each other so that the processing area F is moved at a fixed speed in a direction of the contact line T on the side portion 10'S of the hard, brittle material substrate 10' so that the ejection direction D at the inclination angle θ relative to the contact line T is maintained at each processing point P' after moving for making the elastic abrasive 20 slide along the side surface 10'S of the hard, brittle material substrate 10' in a circumferential direction of the hard, brittle material substrate 10'.

In the method, the workpiece 10 may include a plurality of hard, brittle material substrates 10' having the same shape and stacked such that planar shapes thereof are aligned with each other (see FIGS. 1, 5), and the processing area F may be moved at a fixed speed also in a widthwise direction of the workpiece 10 (i.e., the longitudinal direction of the widthwise line W). For example, the processing area F may be moved helically along the side portion of the workpiece 10.

If the workpiece 10 is a plurality of stacked hard, brittle material substrates 10', a spacer 11 with an outer peripheral shape similar to but slightly smaller than that of the hard, brittle material substrates 10' are preferably interposed between the hard, brittle material substrates 10'.

Preferably, the size of the spacer 11 is adjusted so that the spacer 11 has a thickness (denoted by g in FIG. 2) of 0.01 mm to 5 mm, and a side portion of the spacer 11 and the side portions of the hard, brittle material substrates 10' have a height difference (denoted by h in FIG. 2) of 0.1 mm to 10 mm therebetween.

The spacer 11 may be composed of a resin material and may be formed on one face of each of the hard, brittle material substrates 10' by screen-printing.

Preferably, the elastic abrasives 20 are ejected with the compressed gas at ejection pressure of 0.01 MPa to 0.5 MPa.

The ejection nozzle 30 may be a slit nozzle (not shown) having a slit-shaped ejection port, and the elastic abrasive 20 may be ejected in a state where a lengthwise direction of a slit in the ejection port is aligned with a widthwise direction of the workpiece 10.

With the configuration according to the present invention described above, the method for grinding a side portion of a hard, brittle material substrate according to the present invention can achieve the following notable advantages.

The side portion of a hard, brittle material substrate 10' is ground by ejecting an elastic abrasive 20 thereto together with compressed gas. Moreover, the ejecting process is performing while moving a processing area in the circumferential direction of the workpiece at a fixed speed while maintaining a fixed ejection direction D (inclination angle θ). Consequently, the occurrence of chipping is prevented, and the process is performed uniformly on the side portion of the hard, brittle material substrate 10'.

In addition, since abrasive grains 22 are dispersed in a base material 21 of the elastic abrasive 20 or adhered to the surface of the base material 21, there is no possibility of contamination of the working environment caused by scattered abrasive grains when dried, as in the case where slurry is used. Moreover, cut dust and the like collected together with the elastic abrasive 20 can be readily removed from the elastic abrasive 20 by being separated therefrom by centrifugal separation, such as a cyclone method, so that the elastic abrasive 20 can be used repeatedly. Therefore, the grinding process can be performed economically even if expensive abrasive grains composed of, for example, diamond or cerium oxide, are used for the hard, brittle material substrate.

The workpiece 10 may include a plurality of hard, brittle material substrates 10' having the same shape and stacked such that the planar shapes thereof are aligned with each other, and the processing area F may be moved at a fixed speed also in the widthwise direction of the workpiece. Thus, the plurality of hard, brittle material substrates 10' can be simultaneously processed. In addition, in the method according to the present invention in which the elastic abrasive 20 is ejected together with the compressed gas, the processing conditions can be readily kept constant, and the process can be performed uniformly on the side surface of each of the hard, brittle material substrates 10' disposed at any position in the widthwise direction.

If the plurality of stacked hard, brittle material substrates 10' are to be processed, as described above, a spacer 11 with an outer peripheral shape similar to but slightly smaller than that of the hard, brittle material substrates 10' may be disposed between the hard, brittle material substrates 10' so that not only is the side surface of each hard, brittle material substrate 10' ground, but also the edges thereof can be chamfered or the chamfered surfaces can be ground at the same time.

In particular, the spacer may have a thickness (denoted by g in FIG. 2) of 0.01 mm to 5 mm, and a side portion of the spacer and the side portions of the hard, brittle material substrates may have a height difference (denoted by h in FIG. 2) of 0.1 mm to 10 mm therebetween. Thus, chamfered sections can be properly formed or surfaces formed by chamfering can be properly ground, thereby properly preventing grinding of undesired areas.

The spacer 11 can be formed relatively easily by screen-printing. Moreover, the spacer 11 may be formed on one face of each hard, brittle material substrate 10' by screen-printing. This eliminates the need for a complicated process, such as positioning the spacer 11 relative to each hard, brittle material substrate 10', and also prevents subsequent positional displacement thereof, thereby readily maintaining a fixed height difference (denoted by h in FIG. 2) between the side portion of the spacer 11 and the side portion of each hard, brittle material substrate 10' around the entire perimeter.

The compressed gas ejected together with the elastic abrasive 20 may have an ejection pressure of 0.01 MPa to 0.5 MPa. Thus, the occurrence of chipping can be prevented, and the grinding process can be performed relatively efficiently. In addition, an ejection nozzle 30 may be a slit nozzle (not shown) so that the area that can be simultaneously processed can be increased. Moreover, with the slit nozzle, the ejection condition for the abrasive is constant in the lengthwise direction of the slit. Therefore, when the plurality of stacked hard, brittle material substrates are to be processed, variations in the quality can be reduced in the widthwise direction.

BRIEF DESCRIPTION OF THE DRAWINGS

The objects and advantages of the invention will become understood from the following detailed description of preferred embodiments thereof in connection with the accompanying drawings in which like numerals designate like elements, and in which.

DETAILED DESCRIPTION OF THE PREFERRED EMBODIMENT

Figure 1:
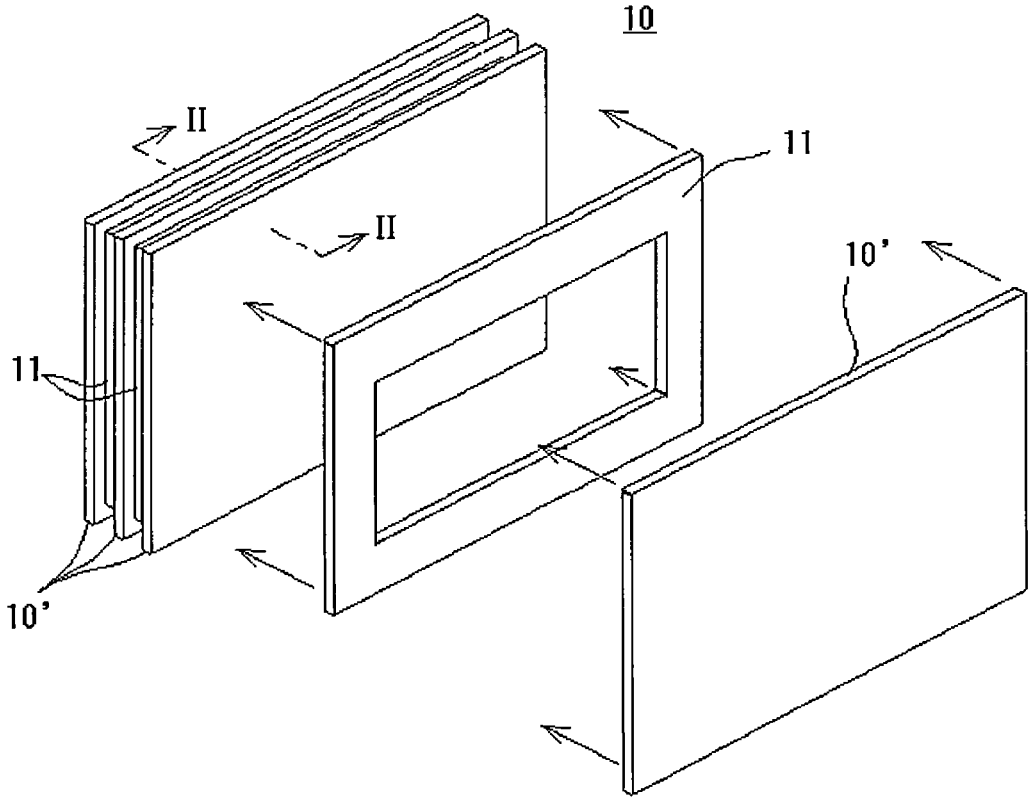
FIG. 1 is an exploded perspective view showing a configuration example of a workpiece formed of a plurality of stacked hard, brittle material substrates.

Next, an embodiment of the present invention will be described below with reference to the appended drawings.

Workpiece

In the present invention, a workpiece whose side portion is to be ground is assumed to be a substrate composed of a hard, brittle material, and due to being hard but also brittle, i.e., lacking toughness, the substrate tends to cause chipping easily during a grinding process. The term "brittle" means "nature which is generally hard but easily breakable and has small deformability. The nature is compared by means of impact values in an impact test.", "nature of which plastic flow generated until breaking when the material is broken is small." (JIS (Japanese Industrial Standards) Technical Term Dictionary, 2001, 5th edition). Generally, a brittle material has a nature of small tensile strength and large compressive strength. As an example, a transparent quartz glass (Covalent Materials Cooperation) has a tensile strength of 110 MPa (in Room temperature, rod-shape of 7 mm diameter) and compressive strength of 1130 MPa (in Room temperature, rod-shape of 24 mm diameter).

Examples of such a material include glass (e.g., soda-lime glass: new Mohs hardness of 6), quartz (new Mohs hardness of 8), ceramic (new Mohs hardness of 9 to 13), and sapphire (new Mohs hardness of 14). Although the grinding method according to the present invention may be applied to any of these materials, the application of the method to glass substrates, which are industrially mass-produced as flat-panel substrates or hard-disk substrates, is particularly promising.

Examples of glass materials to be ground by using the method according to the present invention include, but are not limited to, soda glass, soda-lime glass, alkali glass, non-alkali glass, and high-strain-point glass, which are used in substrates for flat-panel displays, aluminosilicate glass and crystallized glass, which are used in substrates for hard disks, borosilicate glass (heat-resistant glass), potash glass, crystal glass, quartz glass, and tempered glass.

The shape of the workpiece is not limited in particular so long as the workpiece is in the form of a (plate-like or sheet-like) substrate, and may be rectangular-shaped which is a common shape for flat panels, or circular-shaped (donut-shaped) which is a common shape for hard disks. Some flat panels are designed in a geometric pattern depending on components to be mounted thereon, and even in such a case, the grinding method according to the present invention can be used. In particular, although it is difficult to grind a substrate having a shape with inwardly recessed portions, like a heart-shaped substrate in particular, in the related art, a substrate with such a shape can be appropriately ground by using the method according to the present invention.

With regard to the hard, brittle material substrate to be processed, such as a glass substrate, a substrate cut out from mother glass may be directly processed in the present invention, or a substrate whose side portion has been roughly ground and chamfered in advance as a pretreatment by using a grindstone and the like may be processed in the present invention. If such a pretreated substrate is to be processed, the processing time for the method according to the present invention can be shortened.

A workpiece 10 according to the present invention may be a single hard, brittle material substrate 10' or a plurality of stacked hard, brittle material substrates 10'.

If the workpiece 10 is a plurality of stacked hard, brittle material substrates 10', plate-like spacers 11 with an outer peripheral shape similar to but slightly smaller than that of the hard, brittle material substrates 10' are preferably interposed between the hard, brittle material substrates 10', as shown in FIG. 1.

Figure 2:
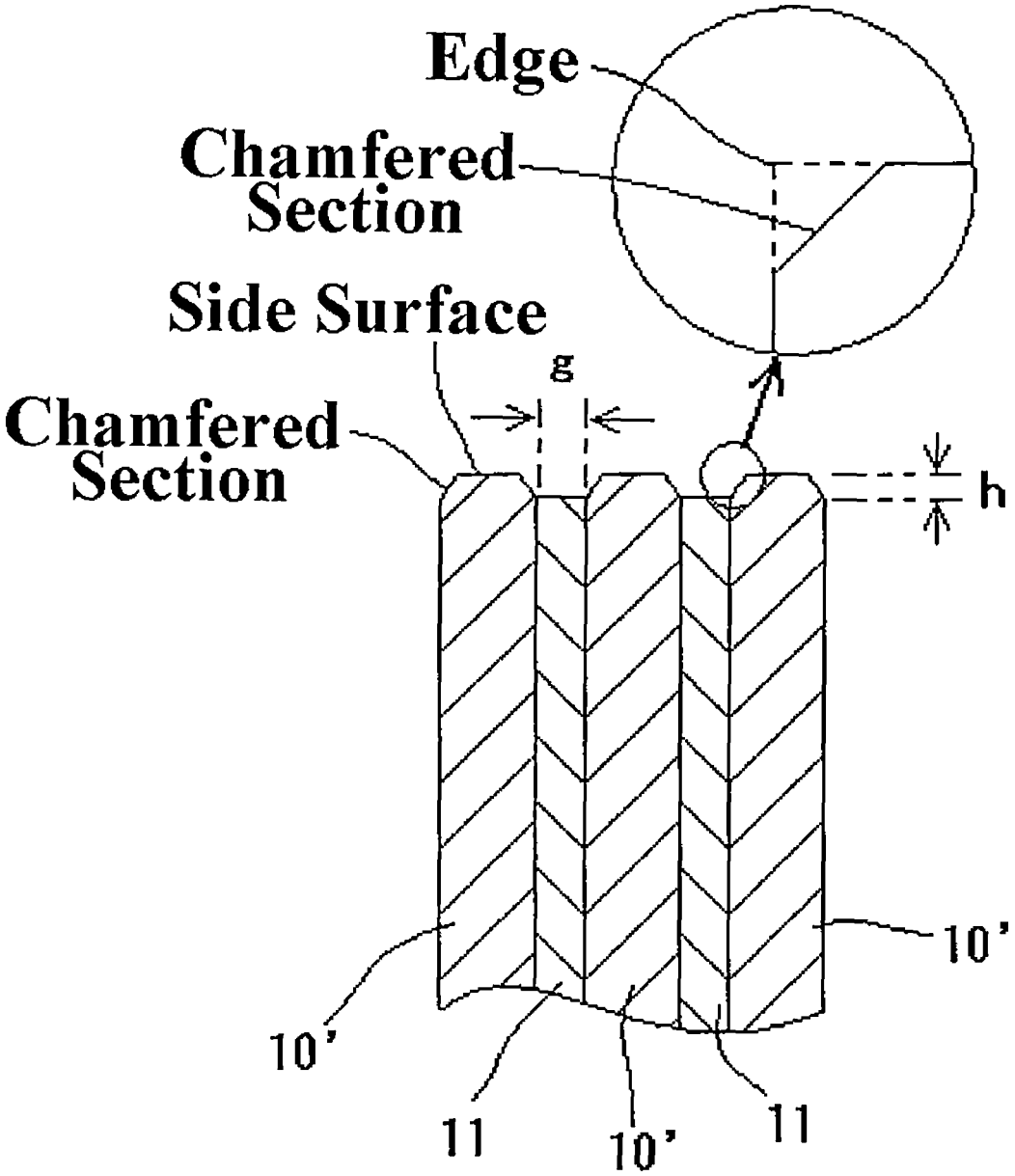
FIG. 2 is a cross-sectional view taken along line II-II in FIG. 1.

With these spacers 11, gaps g corresponding to the thickness of the spacers 11 are formed between the side portions of neighboring substrates 10', and a height difference h is created between the outer periphery of each spacer 11 and the outer periphery of each substrate 10', as shown in FIG. 2. Thus, the edges of the substrates 10' in addition to the outer peripheral surfaces thereof can be simultaneously chamfered and ground.

The spacers 11 may each have a frame-like structure with no central portion, as shown in FIG. 1, so long as they can regulate the gaps between the substrates 10'.

The gaps g between the aforementioned substrates 10' and the height difference h between the outer peripheries of the substrates and the spacers may vary depending on the thickness of the substrates to be processed and the amount of chamfering. Preferably, the gaps g each range between 0.01 mm and 5 mm, and the height difference h ranges between 0.1 mm and 10 mm. Therefore, spacers 11 with dimensions that can form such gaps g and height difference h are attached to the substrates.

The spacers 11 may be composed of various kinds of materials, excluding materials that are easily removed when an elastic abrasive 20, to be described later, collides therewith. For example, the spacers 11 may be formed of paper, metal foil, a metal plate, a resin film, or a resin plate.

In particular, if the substrates to be processed are to be used in commercially available products, such as portable phones, game devices, or portable information terminals, and are to be mass-produced, a frame-like plastic spacer, as mentioned above, may be printed on one face of each substrate 10' by screen-printing in view of better productivity and lower costs.

By printing the spacers directly onto the substrates 10' in this manner, the required gaps g and height difference h can be formed by simply stacking the substrates 10', thus eliminating the need for a complicated process, such as positioning of the substrates 10' and the spacers 11.

If the spacers 11 are to be formed by screen-printing in this manner, the spacers 11 may be printed by using UV-curable ink, so that the ink can be cured at a relatively early stage after the printing process by irradiating them with ultraviolet light, thereby allowing for improved productivity.

Elastic Abrasive

Figure 3A:
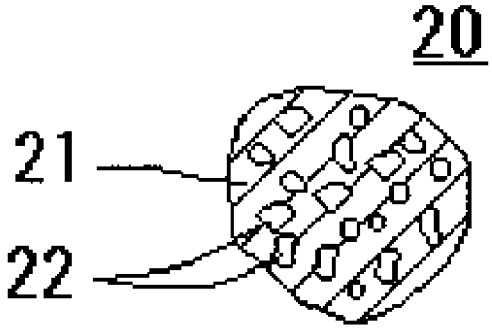
FIGS. 3A and 3B are cross-sectional views showing configuration examples of elastic abrasives, FIG. 3A illustrating an elastic abrasive in which abrasive grains are dispersed within a base material, FIG. 3B illustrating an elastic abrasive in which the abrasive grains are adhered to the surface of the base material.
Figure 3B:
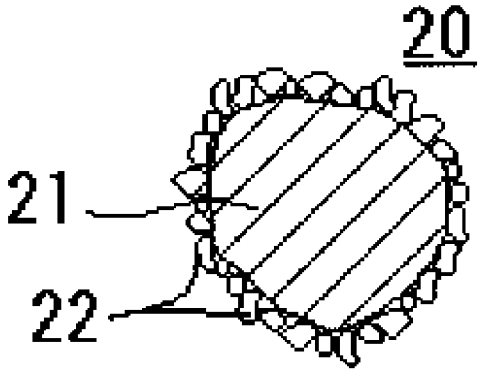

The elastic abrasive 20 used for grinding may be formed by dispersing abrasive grains 22 throughout a base material 21 made of an elastic material, as shown in FIG. 3A (for example, an elastic abrasive discussed in Japanese Patent Laid-Open 2006-159402), or may be formed by adhering abrasive grains 22 over a surface of a base material 21 made of an elastic material having adherence property or by adhering the abrasive grains 22 over a surface of a base material 21 made of an elastic material after applying an adhesive to the surface thereof, as shown in FIG. 3B. When colliding with the workpiece 10, the base material 21 deforms so as to absorb the impact generated during the collision, and the abrasive grains 22 dispersed throughout or adhered to the surface of the base material 21 grind the side portion of each substrate 10'.

The base material 21 of the elastic abrasive 20 may be an elastic body composed of rubber or thermoplastic elastomer and the like. A raw polymer used for obtaining such an elastic body may be in the form of latex, such as liquid rubber or emulsion, in addition to a solid type.

In order to suppress the impact resilience of the base material 21 and the abrasive including the base material 21, it is preferable that they have low impact resilience.

The rubber used may be natural rubber or various kinds of synthetic rubber including, for example, isoprene rubber, styrene-butadiene rubber, butadiene rubber, acrylonitrile-butadiene rubber, chloroprene rubber, ethylene-propylene rubber, chlorosulfonated polyethylene, chlorinated polyethylene, urethane rubber, silicon rubber, epichlorohydrin rubber, and butyl rubber.

Examples of the aforementioned thermoplastic elastomer include styrene block copolymer, chlorinated-polyethylene-based elastomer, polyester-based elastomer, nitrile-based elastomer, fluorine-based elastomer, silicon-based elastomer, ester-halogen-based polymer alloy, olefin-based elastomer, vinyl-chloride-based elastomer, urethane-based elastomer, and polyamide-based elastomer.

The rubber or thermoplastic elastomer, which is a raw polymer, may be used alone or may be used by mixing (combining) multiple kinds thereof.

Alternatively, rubber or thermoplastic elastomer obtained by recycling a collected waste product or a waste product discarded in the manufacturing process may be used.

The raw polymer is mixed with various kinds of compounding agents and is processed as an elastic body constituting the base material.

The following description relates to a case where rubber is used as the raw polymer. Examples of the compounding agents mixed with the rubber polymer include a vulcanizing agent for bridging between rubber molecules, a vulcanization accelerator for accelerating the bridging reaction brought about by the vulcanizing agent, a plasticizer for adding plasticity to the rubber to help with the mixing and dispersing of the compounding agents so as to allow for better processability for rolling and extrusion, a tackifier for imparting adhesiveness required during the rubber manufacturing process so as to allow for better processability, a filler for increasing the volume to reduce the manufacturing cost and also for improving the rubber properties (tensile strength and mechanical properties, such as elasticity) and the processability, and various kinds of compounding agents generally used for forming rubber, such as a stabilizer and a dispersing agent.

Examples of the filler used include inorganic resin, ceramic, and metal, with a degree of hardness lower than that of the abrasive grains, for adding weight to the abrasive. By mixing these materials, the density of the abrasive can be adjusted to that suitable for blasting. Furthermore, for preventing static electricity, a material having conductivity, such as carbon black or metal particles, may also be used.

Although the raw polymer is a rubber polymer in the above embodiment, a thermoplastic elastomer may be used as the raw polymer, as mentioned above. In such case, various kinds of compounding agents generally used for forming a thermoplastic elastomer may be used.

Although the type of abrasive grains 22 dispersed in the base material 21 or adhered to the surface of the base material 21 is not particularly limited, a type that is suitable for grinding a hard, brittle material is selected. Examples include cerium-oxide grains or diamond grains generally used for grinding glass, silicon carbide, aluminum oxide, zirconia, zircon, iron oxide, boron carbide, titanium boride, and mixtures thereof.

The elastic abrasive 20 used has an average grain diameter of 30 μm to 2000 μm. If the grain diameter of the elastic abrasive 20 is too large, it becomes difficult for the elastic abrasive 20 to enter the gaps g between the substrates, making it difficult to grind the chamfered sections. If the grain diameter is too small, the processing amount is reduced, leading to lower productivity due to requiring a longer period of time for the grinding process. A more preferable range for the average grain diameter of the elastic abrasive 20 is between 100 μm and 1000 μm.

The abrasive grains 22 dispersed in the base material 21 of the elastic abrasive 20 or adhered to the surface of the base material 21 have a grit size ranging between #360 and #30000 (average grain diameter ranging between 35 μm and 0.3 μm). If the grain diameter of the abrasive grains 22 is too large, a mirror finished surface cannot be obtained since relatively large scratches are formed on the ground surface. In addition, a large grain diameter can cause chipping, such as formation of micro-cracks. If the grain diameter is too small, the processing amount is reduced, leading to a longer period of time required for the grinding process. A more preferable range for the grit size of the abrasive grains 22 is between #3000 and #20000 (average grain diameter ranging between 4.0 μm and 0.5 μm).

The grain diameters of the elastic abrasive 20 and the abrasive grains 22 may be reduced in a stepwise manner as the grinding process proceeds. In this case, multiple kinds of elastic abrasives 20 with increasing grit numbers (i.e., decreasing grain diameters) of, for example, #320, #600, #1000, #3000, #6000, #10000, and #20000 may be prepared. If the workpiece 10 has a rough surface to be processed, the grinding process may be performed starting with the elastic abrasive with #320 grit and then sequentially using elastic abrasives with higher grit numbers (smaller grain diameters). If the workpiece 10 has a relatively smooth surface to be processed, the grinding process may be performed starting with, for example, the elastic abrasive with #1000 grit and then sequentially using elastic abrasives with higher grit numbers, without using the elastic abrasives with relatively low grit numbers, like #320 and #600 grits.

For the elastic abrasives 20 with lower grit numbers, abrasive grains 22 with relatively low grit numbers are dispersed or adhered thereto. As the grit number of the elastic abrasives 20 becomes higher, the grit number of abrasive grains 22 dispersed or adhered thereto also sequentially becomes higher.

Ejection Method

The aforementioned elastic abrasive 20 is ejected toward the side portion of each substrate 10' serving as the workpiece 10 from an ejection nozzle 30 together with compressed gas, namely, compressed air in this embodiment.

The ejection pressure of compressed air to be used for ejecting the elastic abrasive 20 is appropriately adjustable in accordance with the grain diameter of the elastic abrasive to be used, the grain diameter of the abrasive grains dispersed therein or adhered thereto, and the state (roughness) of a final finished surface to be obtained. For example, the ejection pressure ranges between 0.01 MPa and 0.5 MPa. If the ejection pressure is set too low, the processing amount is reduced, leading to lower productivity due to requiring a longer period of time for the processing. On the other hand, setting the ejection pressure too high gives the substrate an irregular surface and thus deteriorates the surface roughness, leading to reduced strength.

A more preferable range for the ejection pressure is between 0.02 MPa and 0.3 MPa. If a glossy surface is to be obtained on a hard, brittle material substrate composed of glass or quartz and the like, the ejection pressure more preferably ranges between 0.05 MPa and 0.3 MPa.

The ejection nozzle 30 used for the ejection may be a round nozzle with a circular ejection port. If the grinding process is to be performed simultaneously on a plurality of stacked substrates, as mentioned above, it is preferable that a slit nozzle (not shown) with a rectangular-slit-shaped ejection port be used. By using such a slit nozzle, variations in ejection speed of the elastic abrasive in the lengthwise direction of the slit can be suppressed, as compared with a round nozzle, whereby the process can be performed uniformly.

If such a slit nozzle is to be used, the lengthwise direction of the slit is aligned with the widthwise direction of the workpiece.

Figure 4A:
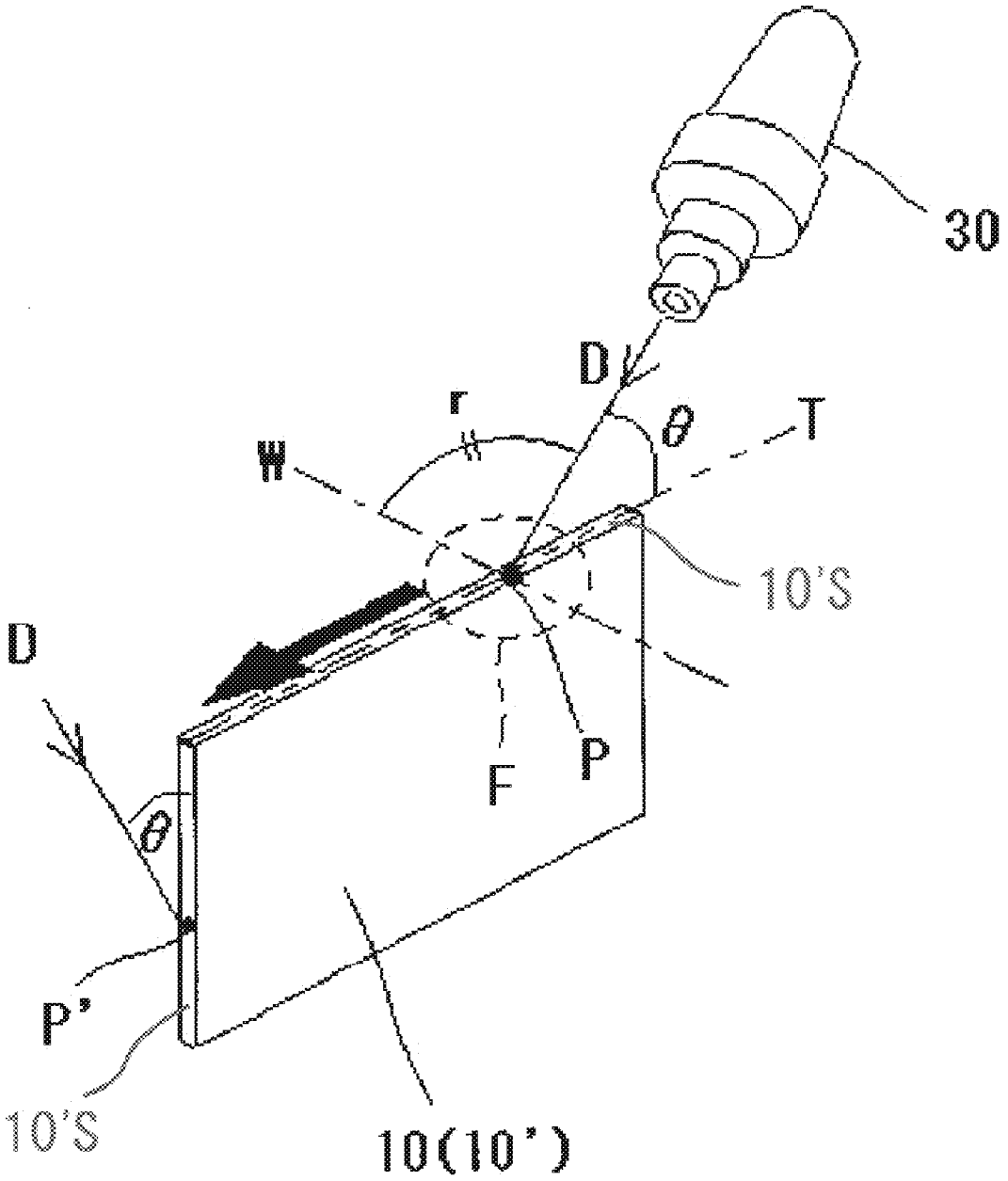
FIGS. 4A and 4B illustrate a method for grinding the workpiece (formed of a single substrate), FIG. 4A illustrating a processing example of a rectangular-shaped substrate, and FIG. 4B illustrating a processing example of a circular-shaped substrate.
Figure 4B:
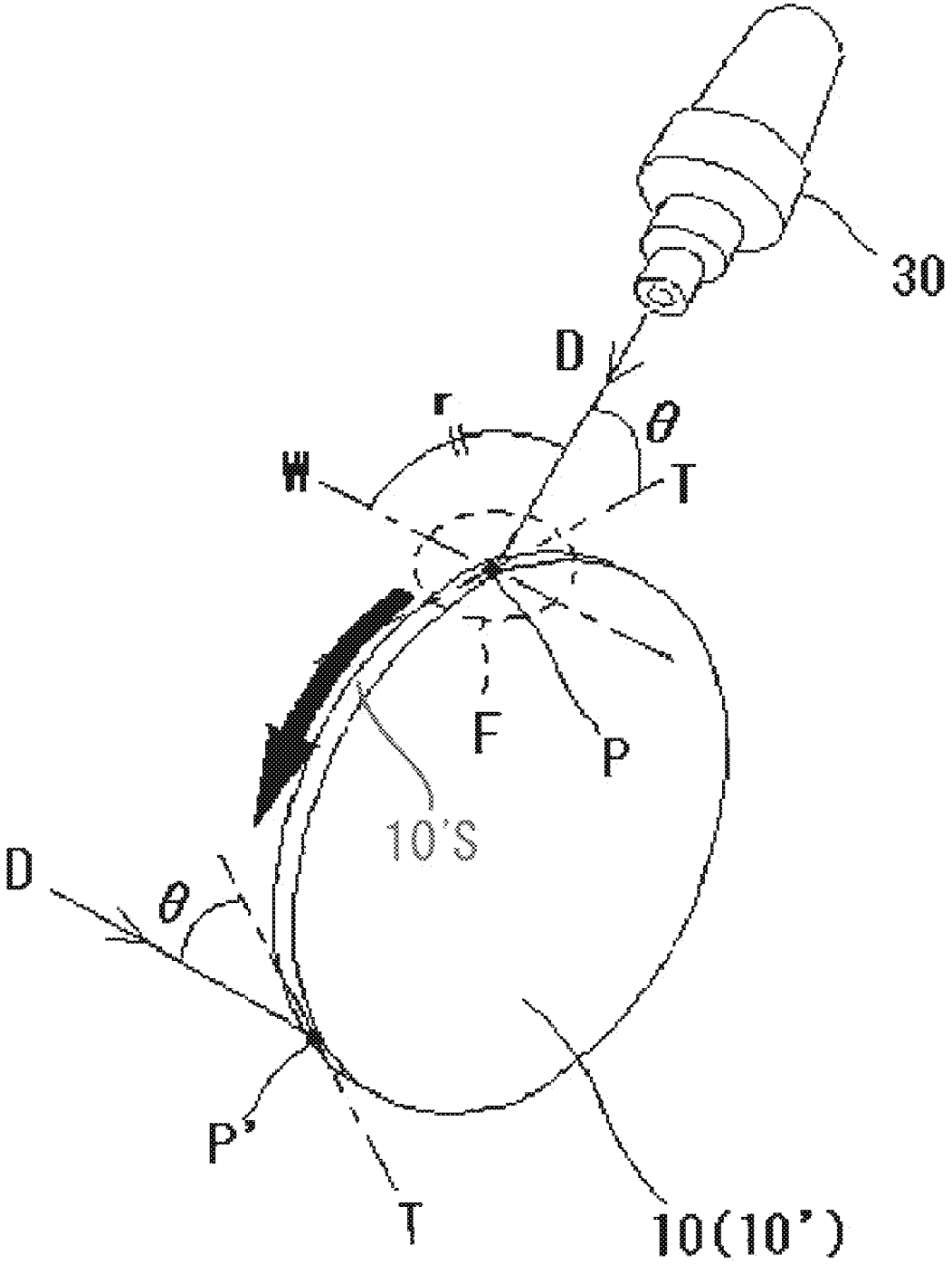

As shown in FIGS. 4A and 4B, with regard to the ejection of the elastic abrasive 20, one point on the side portion of the workpiece 10 (i.e., substrate 10') is set as a processing point P. Assuming that a widthwise line W of the workpiece extends through the processing point P, and a contact line T extends orthogonally to the widthwise line W and is in contact with the side portion (side surface) of the substrate 10' at the processing point P, the elastic abrasive is ejected toward a predetermined processing area F centered on the processing point P in an ejection direction D that intersects the widthwise line W at the processing point P and forms a predetermined inclination angle θ with the contact line T. Moreover, the ejection nozzle 30 and the workpiece 10 (substrates 10') are moved relatively to each other so that the processing area F is moved at a fixed speed in the circumferential direction of the workpiece (see arrows in FIGS. 4A and 4B) and so that the ejection direction D is maintained at the inclination angle θ at a processing point P' in each position.

Although an intersection angle between the ejection direction D and the widthwise line W is a right angle (90°) in the embodiment shown in the drawing, this intersection angle r may be within a range between 0° and 90°.

With regard to the relative movement described above, the ejection nozzle 30 may be moved, the substrates 10' may be moved, or both of them may be moved.

With a smaller inclination angle θ, the elastic abrasive 20 can readily slide on the side surface of the workpiece 10 (substrate 10'). However, an excessively small inclination angle θ leads to reduced cuttability. On the other hand, an excessively large inclination angle θ makes it difficult for the elastic abrasive 20 to slide on the side surface of the workpiece 10 (substrate 10'). Thus, when the elastic abrasive 20 collides with the workpiece 10, the impact generated is not sufficiently absorbed, so that protrusions and depressions are formed on the side surface of the workpiece 10. As a result, the required smoothness cannot be obtained. Therefore, the inclination angle θ ranges between 2° and 60°, preferably, between 5° and 30°.

Furthermore, the relative movement of the workpiece 10 and the ejection nozzle 30 is performed such that the aforementioned processing area F (processing point P) moves in the circumferential direction of the workpiece 10 at about 3 mm/s to 1000 mm/s.

Figure 5:
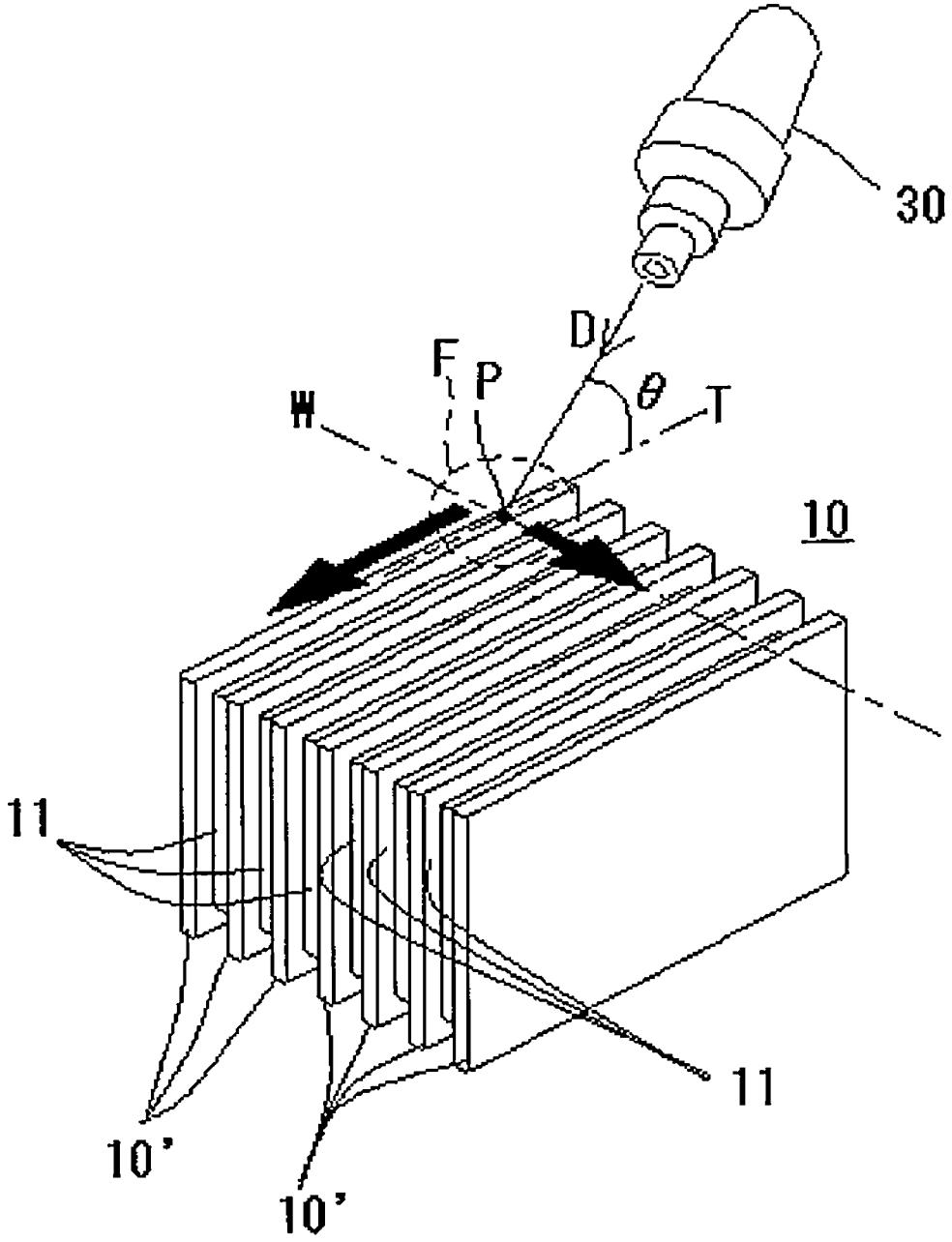
FIG. 5 illustrates the method for grinding the workpiece (formed of stacked substrates)

As described above with reference to FIG. 1, if the workpiece 10 is a plurality of stacked substrates 10', the process shown in FIG. 5 is gradually performed at a predetermined speed not only in the circumferential direction of the workpiece 10 (i.e., the longitudinal direction of the contact line T) but also in the widthwise direction (i.e., the longitudinal direction of the widthwise line W) so that the trajectory of the aforementioned processing area F (processing point P) is helical along the outer periphery of the workpiece.

Advantages

When the elastic abrasive 20 is ejected together with the compressed air toward the side portion of the workpiece 10 in the above-described manner, the ejected elastic abrasive 20 collides with the side surface of the workpiece 10 (each substrate 10'). Because the impact generated during the collision is absorbed due to deformation of the base material 21 of the elastic abrasive 20, a large impact is not applied to the substrate 10'.

Accordingly, the elastic abrasive 20 deforms so as to absorb the impact generated during the collision, and is also prevented from bouncing off the side surface of the substrate 10' since the elastic abrasive 20 is ejected in the ejection direction D inclined at the predetermined inclination angle θ, as described above. Therefore, the elastic abrasive 20 slides along the side surface of the substrate 10' in the circumferential direction of the substrate 10'. Moreover, during the sliding of the elastic abrasive 20, the abrasive grains 22 dispersed in the base material 21 of the elastic abrasive 20 or adhered to the surface of the base material 21 exhibit a cutting force so that the surface roughness of the side surface of the substrate 10' is improved.

The elastic abrasive 20 that falls off from the widthwise ends (edges) of the substrate 10' without sliding on the side surface thereof cuts and chamfers the edges along the widthwise ends of the side surface of the substrate 10' or grinds chamfered surfaces if the substrate 10' has already been chamfered, thereby improving the roughness of the entire side portion of the substrate, as well as removing chipping formed in a front-end process.

In particular, if a plurality of stacked substrates 10' are to be processed, the spacers 11 are interposed between the substrates 10' so that not only is the side surface of each substrate 10' ground, but also the edges that tend to crack are removed and chamfered, or the chamfered surfaces are ground, whereby the deflective strength of the substrates 10' can be reliably increased.

Accordingly, with the method according to the present invention, the surface roughness is improved without chipping the substrates 10', and the edges are chamfered or the chamfered surfaces are ground, whereby the mechanical strength, such as deflective strength, is significantly increased.

In addition, since the abrasive grains 22 are dispersed in the base material 21 or adhered to the surface of the base material 21, the working environment is prevented from being contaminated by scattered abrasive grains 22. Furthermore, the elastic abrasive 20 can be readily distinguished from cut dust and the like and can thus be used repeatedly. Moreover, because substantially constant processing conditions can be maintained for the substrates 10' even with such repeated usage, an economical grinding process can be performed even if expensive abrasive grains 22 composed of diamond or cerium oxide are used.

EXAMPLE

A processing example in which ends of a glass substrate are ground by the grinding method according to the present invention will be described below.

Workpiece

After scribing a soda-lime glass, 100 glass substrates (30 mm by 80 mm by 1.8 mm) whose peripheral edges were chamfered by using a grindstone were stacked with spacers interposed therebetween, whereby a workpiece was obtained.

The spacers were each formed by printing UV-curable ink on one face of each glass substrate by screen-printing and then curing the ink by emitting ultraviolet light thereto.

The UV-curable ink used included urethane acrylate as resin, a monofunctional monomer and a polyfunctional monomer as monomers, an organic pigment as a sensitizer, a leveling agent, an anti-foaming agent, silica, and a thixotropic agent as auxiliary agents, and was printed by using a 150-mesh screen manufactured by SUS Corporation.

Processing Conditions

As the elastic abrasive, "SIRIUS® MEDIA" manufactured by Fuji Manufacturing Co., Ltd., which had abrasive grains embedded in an elastic base material, was ejected by using the blasting device "FDD-SR" manufactured by Fuji Manufacturing Co., Ltd. The elastic abrasive was ejected with the ejection pressures shown in Table 1 below.

The inner diameter of the tip of a nozzle used was 5 mm, the inclination angle θ shown in FIGS. 4A, 4B and 5 was 20°, and the distance from the tip of the nozzle to the surface of the workpiece was 50 mm.

TABLE 1

Processing Conditions

| Elastic Abrasive Used | Overall Grain diameter (μm) | Material and Grain diameter (μm) of Abrasive Grains | Ejection Pressure (MPa) | Processing Time (Minutes) |
|---|---|---|---|---|
| #320 | 30-2000 | Silicon Carbide D50 (40) | 0.3 | 10 |
| #600 | 30-2000 | Silicon Carbide D50 (20) | 0.3 | 10 |
| #1000 | 30-2000 | Silicon Carbide D50 (12) | 0.3 | 10 |
| #3000 | 100-1000 | Silicon Carbide D50 (4) | 0.3 | 10 |
| #6000 | 100-1000 | Silicon Carbide D50 (2) | 0.3 | 10 |
| #10000 | 100-500 | Diamond D50 (0.6) | 0.1 | 10 |

In Table 1 above, the ejection pressure was the pressure of compressed air supplied to the nozzle.

Only when a #10000-grit elastic abrasive was used, the ejection pressure was set at 0.1 MPa, which was lower than that in other examples. This is because the improvement in surface roughness is reduced if the process is performed with 0.3 MPa when using the #10000-grit elastic abrasive.

Figure 6:
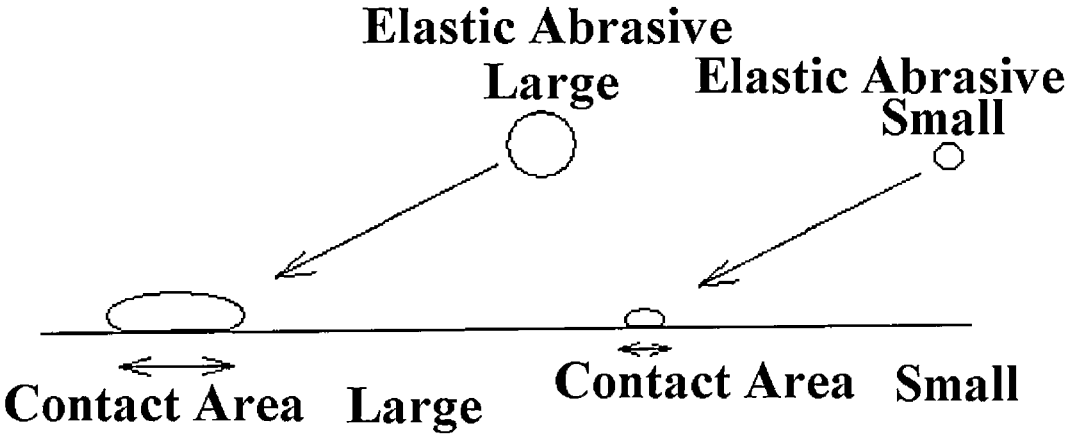
FIG. 6 is an enlarged view illustrating deformation of the elastic abrasives, and contact areas thereof with the workpiece.
Figure 7:
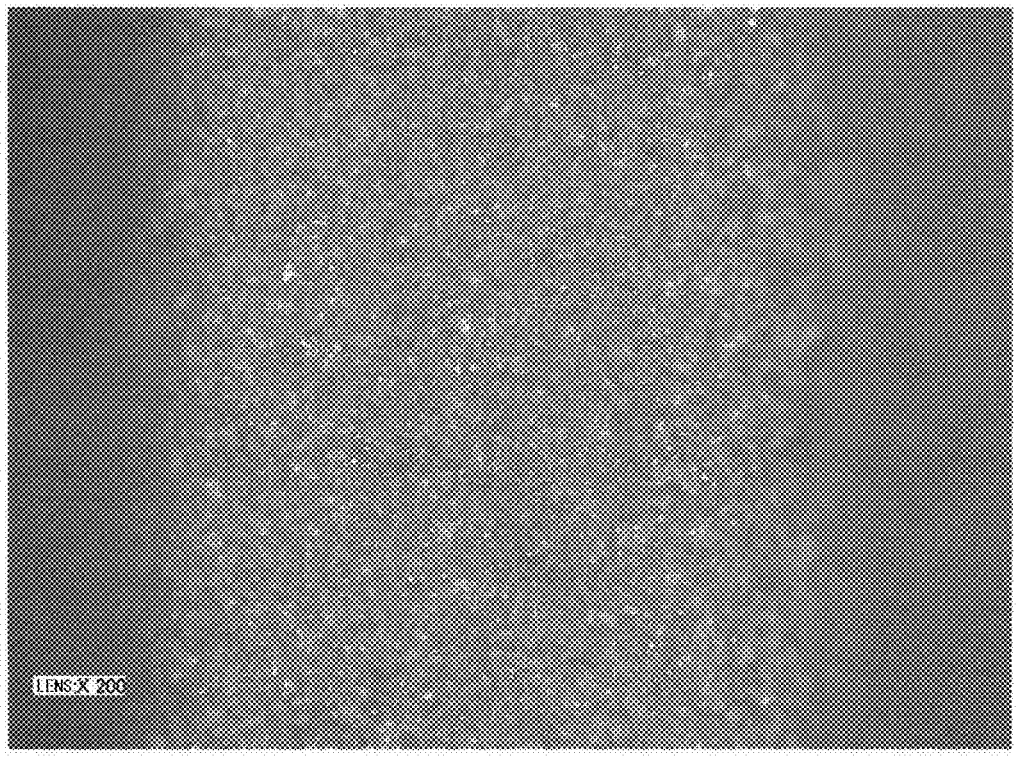
FIG. 7 illustrates a photograph, taken with an optical microscope, of a side portion of a glass substrate that is ground by using a #320-grit elastic abrasive based on the method according to the present invention.
Figure 8:
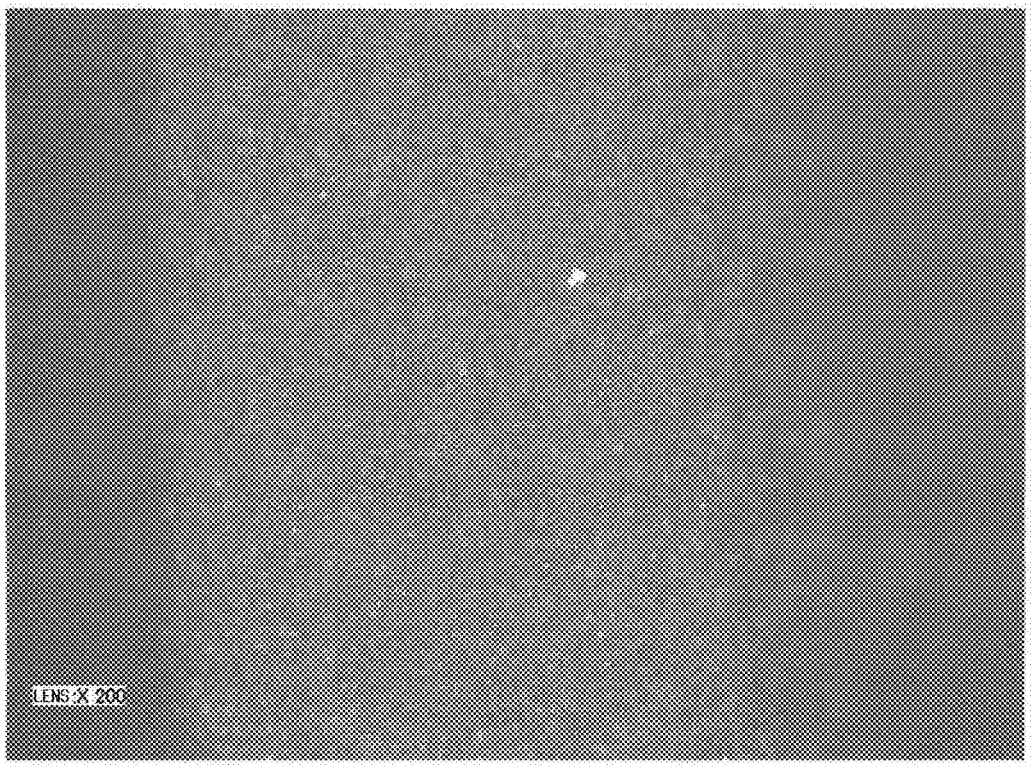
FIG. 8 illustrates a photograph, taken with an optical microscope, of a side portion of a glass substrate that is ground by using a #600-grit elastic abrasive based on the method according to the present invention.
Figure 9:
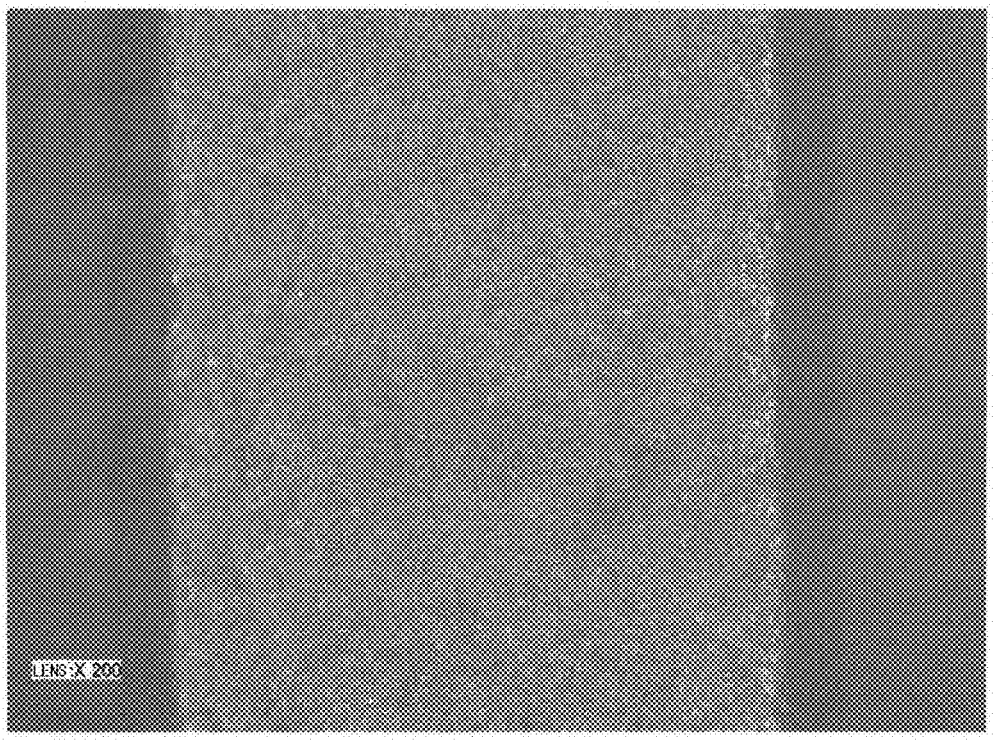
FIG. 9 illustrates a photograph, taken with an optical microscope, of a side portion of a glass substrate that is ground by using a #1000-grit elastic abrasive based on the method according to the present invention.
Figure 10:
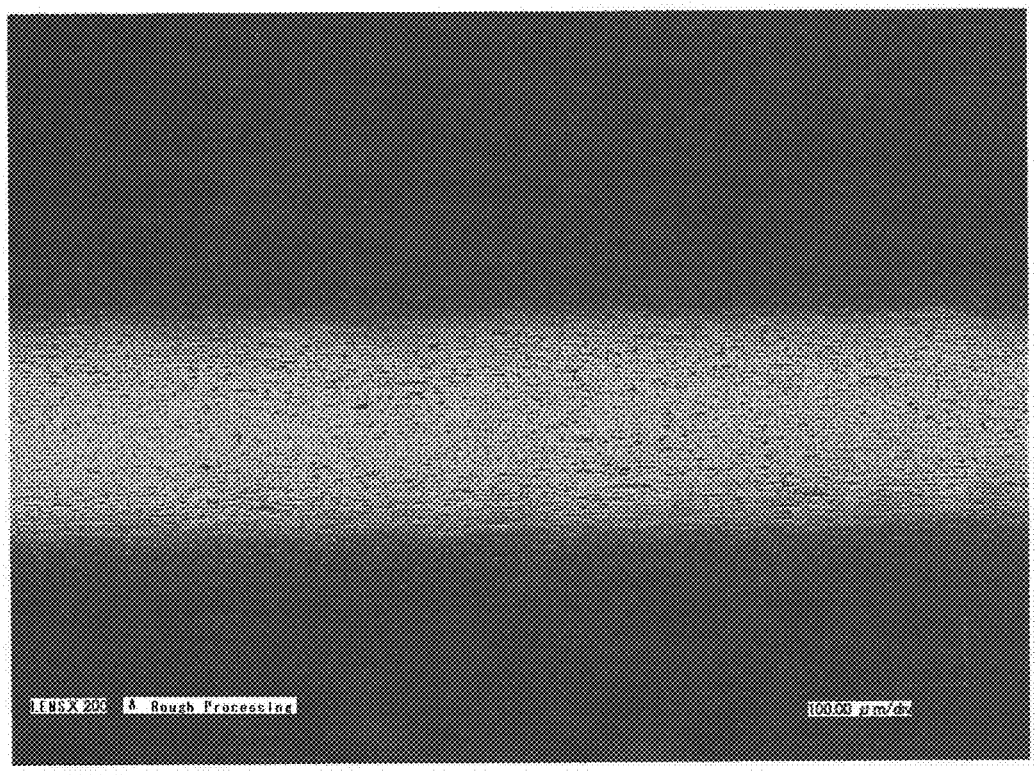
FIG. 10 illustrates a photograph, taken with an optical microscope, of a side portion of a glass substrate that is ground by using a #3000-grit elastic abrasive based on the method according to the present invention.
Figure 11:
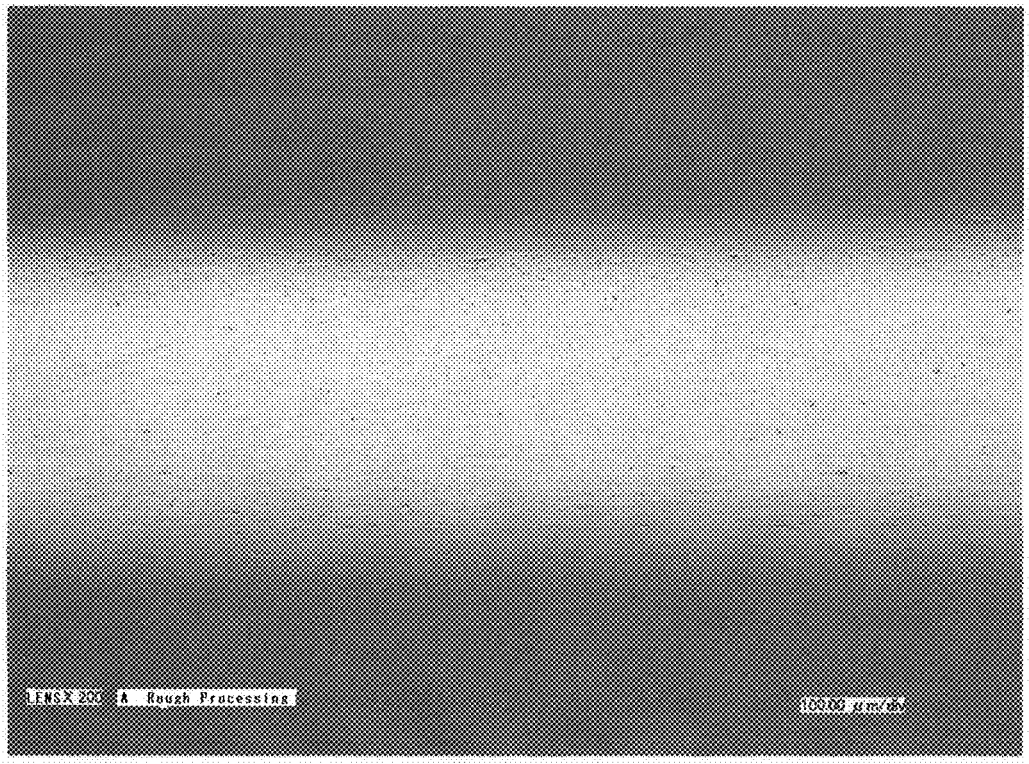
FIG. 11 illustrates a photograph, taken with an optical microscope, of a side portion of a glass substrate that is ground by using a #6000-grit elastic abrasive based on the method according to the present invention.
Figure 12:
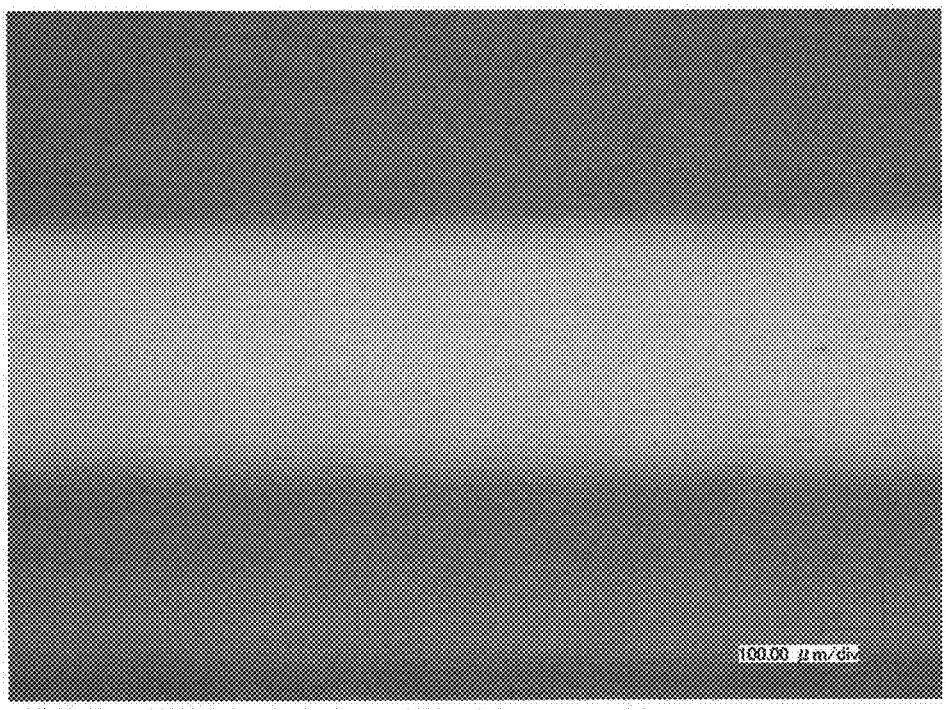
FIG. 12 illustrates a photograph, taken with an optical microscope, of a side portion of a glass substrate that is ground by using a #10000-grit elastic abrasive based on the method according to the present invention.
Figure 13:
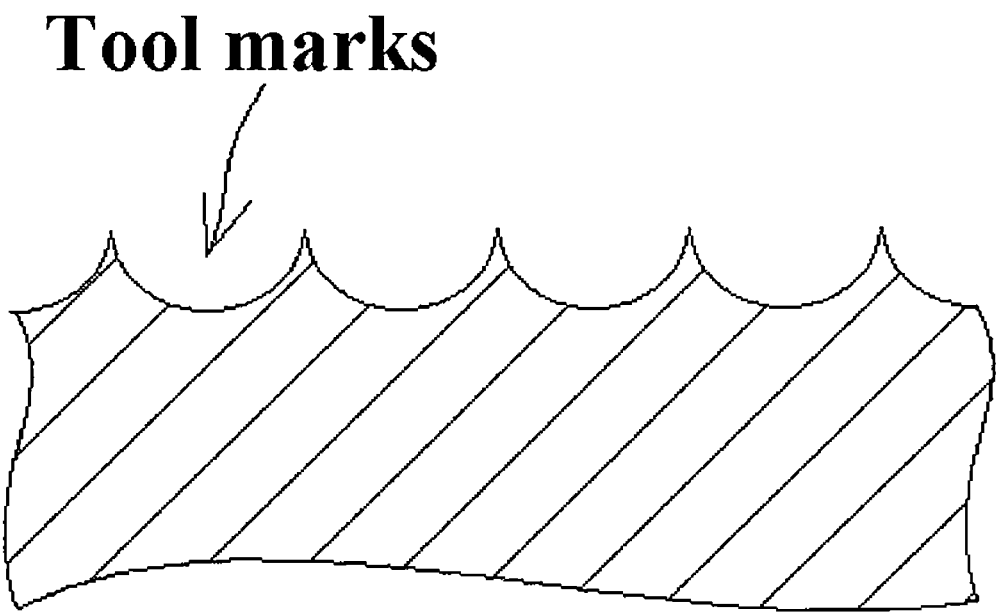
FIG. 13 illustrates tool marks.
Figure 14:
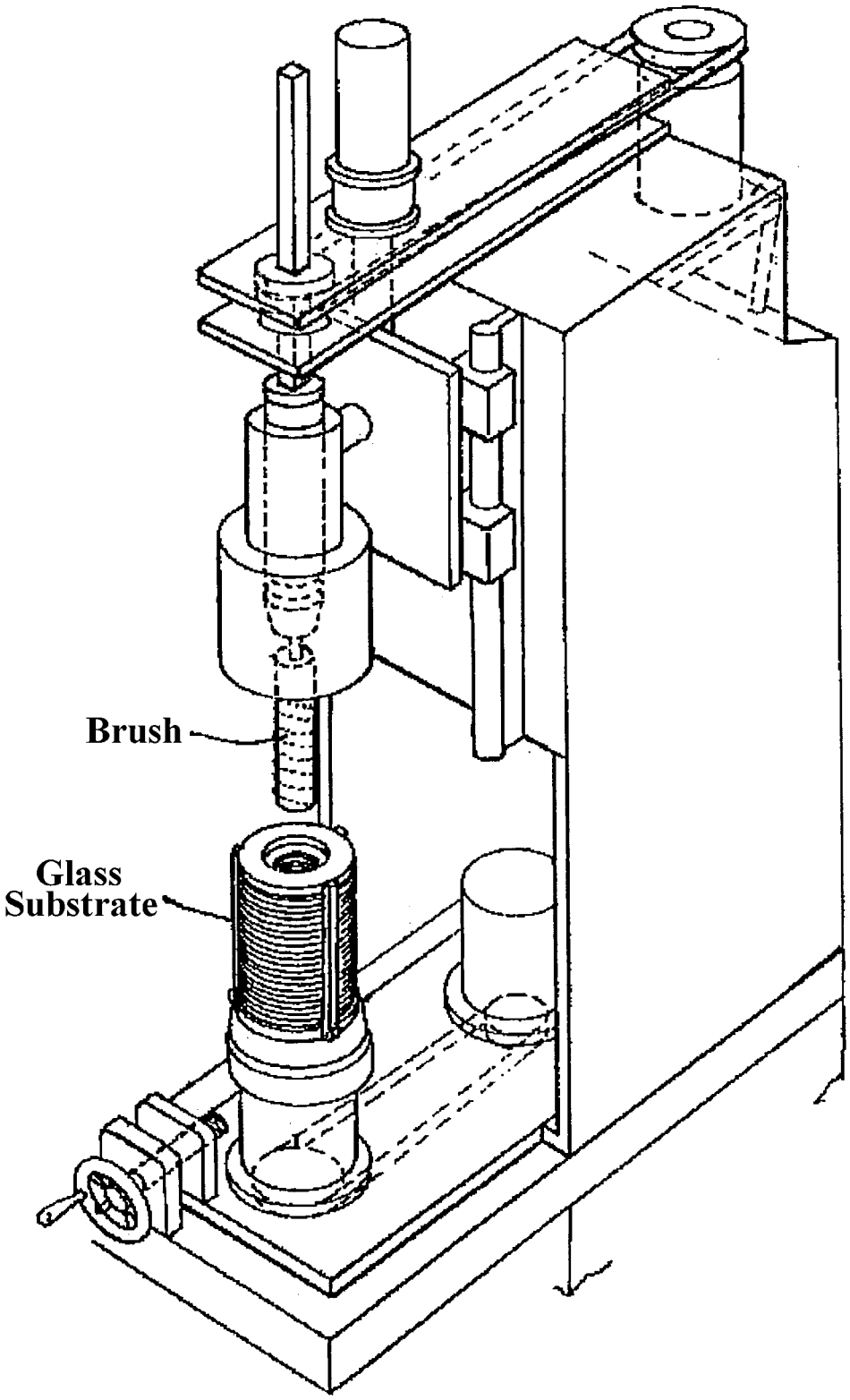
FIG. 14 Related Art
FIG. 14 illustrates a brush-based grinding technique in the related art (corresponding to FIG. 1 in Japanese Patent Laid-Open No. H11-33886).

Specifically, as shown in FIG. 6, the elastic abrasive deforms when landing on (colliding with) the surface of the workpiece so that the collision energy is less likely to concentrate in one area. If the elastic abrasive is ejected with high ejection pressure, the collision energy locally concentrates in one area so that the collision area is selectively processed, making it difficult to obtain a smooth surface. Thus, the ejection pressure can be utilized for adjusting the surface roughness. Furthermore, a final finished surface can be obtained by reducing the grain diameter of the abrasive so as to reduce the collision energy.

Processing Result 1: Surface Roughness

The state of the surface of a side portion of a glass substrate processed by the above-described method was observed with an optical microscope, and the surface roughness was measured.

FIGS. 7 to 11 show photographs of the surface of the side portion obtained with the optical microscope, and Table 2 below shows the measurement results of the surface roughness.

The surface of the side portion was observed by using a laser microscope (VK8500 manufactured by Keyence Corporation), and the surface roughness was measured based on a non-contact method using this optical microscope. Specifically, by using a 50× objective lens, an area of 66,700 $\mu m^2$ (298 μm×224 μm) was measured.

TABLE 2

Measurement Results of Surface Roughness

| Abrasive | Ra (μm) | Rz (μm) |
|---|---|---|
| Before Process | 1.52 | 10.23 |
| #320 | 1.40 | 8.61 |
| #600 | 1.18 | 5.68 |
| #1000 | 0.92 | 5.10 |
| #3000 | 0.56 | 4.50 |
| #6000 | 0.04 | 0.24 |
| #10000 | 0.03 | 0.12 |

The above results show that the side portion of the glass substrate was planarized by being ground by the method according to the present invention. In particular, the smaller the grain diameter of the elastic abrasive used, the smoother the side portion. It was confirmed that the process according to the method of the present invention is advantageous in that it removes defects, such as chipping, which may cause the glass to break, formed at the edges of the glass substrate.

Processing Result 2: Strength Test

A deflective strength test was performed on each glass substrate processed by the above-described method according to the present invention, and the strength of the aforementioned glass substrate was compared with the strength of a glass substrate ground by a known slurry-based grinding method.

Of the aforementioned examples, the glass substrates for which the strength test was performed were glass substrates that were first processed by using a #6000-grit elastic abrasive and subsequently processed by using a #10000-grit elastic abrasive. After performing blasting, the stacked glass substrates were separated from each other. The strength of 20 of the glass substrates (30 mm by 80 mm by 1.8 mm) obtained by removing the spacers therefrom was measured, and an average value was obtained.

The deflective strength test was performed by using a universal testing device "5582" manufactured by Instron Co., Ltd. Specifically, the opposite ends of each glass substrate were supported at a fixed pitch of 60 mm, and the center of the glass substrate was pressed at 0.5 mm/min until the glass substrate broke, then a load (N) corresponding to when the glass substrate broke was measured.

For comparison, glass substrates composed of the same material and having the same dimensions as the glass substrates processed by the method according to the present invention were prepared. Specifically, the edges of each glass substrate were chamfered by using an #800-grit diamond grindstone, and the glass substrate was subsequently lapped by performing a brush-based grinding process in a stepwise fashion using slurry containing #3000-grit cerium-oxide abrasive grains and slurry containing #10000-grit cerium-oxide abrasive grains. The deflective strength test was similarly performed on these glass substrates by using the same method.

As a result, assuming that the average deflective strength value of the glass substrates lapped by brush-based grinding is 100, the average deflective strength value of the glass substrates ground by the method according to the present invention was 98. Since the difference was within an error range, substantially the same strength was obtained.

Regarding the substrates obtained after performing brush-based grinding thereon using slurry containing cerium abrasive grains, the deflective strength thereof varied within a range of about ±10% relative to the average value. On the other hand, with regard to the glass substrates whose side portions were ground by the method according to the present invention, the deflective strength thereof varied within a range of about ±5%, thus, it was confirmed that variations in processing accuracy were reduced.

Consequently, with the method according to the present invention, the chipping, which may cause the glass to break, can be removed in a similar manner to the time-proven brush-based grinding method using cerium-oxide slurry, and it was confirmed that variations in processing accuracy among products can be reduced, as compared with the known grinding method.

Thus the broadest claims that follow are not directed to a machine that is configure in a specific way. Instead, said broadest claims are intended to protect the heart or essence of this breakthrough invention. This invention is clearly new and useful. Moreover, it was not obvious to those of ordinary skill in the art at the time it was made, in view of the prior art when considered as a whole.

Moreover, in view of the revolutionary nature of this invention, it is clearly a pioneering invention. As such, the claims that follow are entitled to very broad interpretation so as to protect the heart of this invention, as a matter of law.

It will thus be seen that the objects set forth above, and those made apparent from the foregoing description, are efficiently attained and since certain changes may be made in the above construction without departing from the scope of the invention, it is intended that all matters contained in the foregoing description or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

Now that the invention has been described;

What is claimed is:

1. A method for grinding a side portion of a hard, brittle material substrate, wherein a side portion of a workpiece formed of a plurality of hard, brittle material substrates having the same shape and stacked such that planar shapes thereof are aligned with each other and the surfaces of the side portions of the hard, brittle material substrates are aligned in parallel at equal intervals are ground by ejecting an elastic abrasive made of abrasive grains dispersed in an elastic base material or an elastic abrasive made of abrasive grains adhered to a surface of an elastic base material, from an ejection nozzle toward the side portion of the workpiece together with compressed gas, excluding a slurry, so as to make the elastic abrasive collide with the side portion, the method comprising:

disposing a spacer with an outer peripheral shape similar to but slightly smaller than that of each of the hard, brittle material substrates between the hard, brittle material substrates so that a fixed height difference is created between the side portion of the spacer and the side portion of each of the hard, brittle material substrate around the entire perimeter;

setting one point on the side portion arranged at a surface in a vertical direction of the hard, brittle material substrate as a processing point P, wherein a widthwise line W of the hard, brittle material substrate extends through the processing point P and that a contact line T on the side portion extends orthogonally to the widthwise line W of the hard, brittle material substrate and the contact line T is in contact with the side portion of the hard, brittle material substrate at the processing point P;

ejecting the elastic abrasive toward a predetermined processing area F centered on the processing point P in an ejection direction D that intersects the widthwise line W at the processing point P and the ejection direction D forms a predetermined inclination angle θ selected from a range of 2° to 60° relative to the contact line T; and moving the ejection nozzle and the hard, brittle material substrate relatively to each other so that the processing area F and the processing point P are moved at a fixed speed in a direction of the contact line T on the side portion of the hard, brittle material substrate so that the ejection direction D at the inclination angle θ relative to the contact line T is maintained at each processing point P' after moving for making the elastic abrasive slide along the side surface of the hard, brittle material substrate in a circumferential direction of the hard, brittle material substrate and the processing area F is moved at a fixed speed also in a widthwise direction of the workpiece so that the side surface of each of the substrate is ground, and the edges of the substrate is chamfered and the chamfered surface of the substrate is ground at the same time for the plurality of hard, brittle material substrates.

2. The method according to claim 1, wherein the hard, brittle material substrate has a new Mohs hardness of 6 to 14.

3. The method according to claim 1, wherein the hard, brittle material substrate is composed of glass, quartz, ceramic, or sapphire.

4. The method according to claim 1, wherein the spacer has a thickness of 0.01 mm to 5 mm, and a side portion of the spacer and the side portions of the hard, brittle material substrates have a height difference of 0.1 mm to 10 mm therebetween.

5. The method according to claim 1, wherein the spacer is composed of a resin material and is formed on one face of each of the hard, brittle material substrates by screen-printing.

6. The method according to claim 1, wherein the elastic abrasives are ejected with the compressed gas at ejection pressure of 0.01 MPa to 0.5 MPa.

7. The method according to claim 1, wherein the ejection nozzle is a slit nozzle having a slit-shaped ejection port, and wherein the elastic abrasive is ejected in a state where a lengthwise direction of a slit in the ejection port is aligned with a widthwise direction of the workpiece.

* * * * *